US007225871B2

(12) United States Patent
Rogers et al.

(10) Patent No.: US 7,225,871 B2
(45) **Date of Patent: *Jun. 5, 2007**

(54) APPARATUS AND METHOD FOR REVERSE CIRCULATION CEMENTING A CASING IN AN OPEN-HOLE WELLBORE

(75) Inventors: Henry E. Rogers, Duncan, OK (US); Earl D. Webb, Duncan, OK (US); Karl Blanchard, Cypress, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/255,573

(22) Filed: Oct. 21, 2005

(65) Prior Publication Data

US 2006/0076135 A1 Apr. 13, 2006

Related U.S. Application Data

(63) Continuation-in-part of application No. 11/014,350, filed on Dec. 16, 2004, and a continuation-in-part of application No. 10/897,249, filed on Jul. 22, 2004.

(51) Int. Cl.
*E21B 33/02* (2006.01)
*E21B 33/05* (2006.01)

(52) U.S. Cl. ..... 166/285; 166/177.4; 166/96.1; 166/90.1; 166/93.1; 166/88.1

(58) Field of Classification Search ..... 166/379, 166/285, 177.4, 96.1, 93.1, 90.1, 88.1, 75.14
See application file for complete search history.

(56) References Cited

U.S. PATENT DOCUMENTS

| | | | | |
|---|---|---|---|---|
| 5,494,107 | A | 2/1996 | Bode | 166/285 |
| 5,890,538 | A * | 4/1999 | Beirute et al. | 166/285 |
| 6,244,342 | B1 | 6/2001 | Sullaway et al. | 166/285 |
| 6,782,947 | B2 * | 8/2004 | de Rouffignac et al. | 166/245 |
| 2004/0231846 | A1 | 11/2004 | Griffith et al. | 166/291 |

(Continued)

FOREIGN PATENT DOCUMENTS

SU 1716096 A1 2/1992

(Continued)

OTHER PUBLICATIONS

Foreign Communication from a Related Counter Part Application, Jan. 8, 2007.

(Continued)

*Primary Examiner*—Jennifer H. Gay
*Assistant Examiner*—Robert Fuller
(74) *Attorney, Agent, or Firm*—John W. Wustenberg; Baker Botts, L.L.P.

(57) ABSTRACT

A system for cementing a casing in an open wellbore having no surface casing, wherein an annulus is defined between the casing and the wellbore, the system having: an annular plug around the casing at the mouth of the wellbore; a cement composition pump fluidly connected to the annulus through the seal; and a coupling connected to the exposed end of the casing for taking circulation fluid returns from the inner diameter of the casing.

19 Claims, 8 Drawing Sheets

U.S. PATENT DOCUMENTS

| | | | | |
|---|---|---|---|---|
| 2005/0189104 | A1* | 9/2005 | Turley et al. | 166/134 |
| 2006/0016599 | A1 | 1/2006 | Badalamenti et al. | 166/285 |
| 2006/0016600 | A1 | 1/2006 | Badalamenti et al. | 166/285 |
| 2006/0042798 | A1 | 3/2006 | Badalamenti et al. | 166/285 |
| 2006/0086499 | A1 | 4/2006 | Badalamenti et al. | 166/250.14 |
| 2006/0086502 | A1 | 4/2006 | Reddy et al. | 166/291 |
| 2006/0086503 | A1 | 4/2006 | Reddy et al. | 166/293 |
| 2006/0131018 | A1 | 6/2006 | Rogers et al. | 166/285 |

FOREIGN PATENT DOCUMENTS

| | | | |
|---|---|---|---|
| SU | 1723309 | A1 | 3/1992 |
| WO | WO 2005/083229 | A1 | 9/2005 |
| WO | WO 2006/008490 | A1 | 1/2006 |
| WO | WO 2006/064184 | A1 | 6/2006 |

OTHER PUBLICATIONS

Foreign Communication from a Related Counter Part Application, Jan. 17, 2007.

* cited by examiner

APPARATUS AND METHOD FOR REVERSE CIRCULATION CEMENTING A CASING IN AN OPEN-HOLE WELLBORE

CROSS-REFERENCE TO RELATED APPLICATIONS

This application is a Continuation-in-Part of application Ser. No. 10/897,249, filed Jul. 22, 2004. This application is also a Continuation-in-Part of application Ser. No. 11/014,350 filed Dec. 16, 2004.

BACKGROUND

The present invention relates generally to apparatuses and methods for cementing tubing or casing in downhole environments, and more particularly to an apparatus and method for reverse circulation cementing a casing in an open-hole wellbore.

During downhole cementing operations, fluid circulation is generally performed by pumping down the inside of the tubing or casing and then back up the annular space around the casing. This type of circulation has been used successfully for many years. However, it has several drawbacks. First, the pressures required to "lift" the cement up into the annular space around the casing can sometimes damage the formation. Furthermore, it takes a fair amount of time to deliver the fluid to the annular space around the casing in this fashion.

In an effort to decrease the pressures exerted on the formation and to reduce pump time requirements, a solution involving pumping the fluid down the annular space of the casing rather than down the casing itself has been proposed. This technique, known as reverse circulation, requires lower delivery pressures, because the cement does not have to be lifted up the annulus. Furthermore, the reverse circulation technique is less time consuming than the conventional method because the fluid is delivered down the annulus only, rather than down the inside of the casing and back up the annulus. Accordingly, the cement travels approximately half the distance with this technique.

There are a number of drawbacks of current reverse circulation methods and devices, however. Such methods require a wellhead or other conventional surface pack-off to be attached to the surface casing that is sealably attached to the casing being cemented in place via the reverse circulation technique. These structures are often complex, permanent and expensive, thus increasing the cost of completing the well.

Furthermore, in some applications, reverse circulation techniques are not even available in the first instance, because there is no access to the annulus from outside the system to pump the cement down the annulus. Such systems include open-hole wells in which casing pipe has been suspended by elevators that rest on boards, such as railroad ties or other similar supports. The problem with these inexpensive well designs is that the elevators and supports block access to the annulus, so it is not possible to employ reverse circulation techniques on them. Such applications are therefore necessarily limited to traditional cementing techniques, i.e., pumping the cement down the casing and back up the annulus. Such applications are therefore susceptible to all of the drawbacks of traditional cementing techniques.

SUMMARY

The present invention is directed to a surface pack-off device, which attaches between the wellbore sidewall and casing that allows for reverse circulation down the annulus formed between the casing to be cemented and the wellbore sidewall.

According to one aspect of the invention, there is provided a method for cementing a casing in an open wellbore having no surface casing, wherein an annulus is defined between the casing and the wellbore, the method having the following steps: sealing the annulus with a plug around the casing at the mouth of the wellbore; pumping a cement composition into the annulus through the plug; and taking circulation fluid returns from the inner diameter of the casing.

Another aspect of the invention provides a system for cementing a casing in an open wellbore having no surface casing, wherein an annulus is defined between the casing and the wellbore, the system having the following element: an annular plug around the casing at the mouth of the wellbore; a cement composition pump fluidly connected to the annulus through the seal; and a coupling connected to the exposed end of the casing for taking circulation fluid returns from the inner diameter of the casing.

The features and advantages of the present invention will be readily apparent to those skilled in the art upon a reading of the description of the exemplary embodiments, which follows.

BRIEF DESCRIPTION OF THE FIGURES

The present invention is better understood by reading the following description of non-limiting embodiments with reference to the attached drawings which are briefly described as follows.

It is to be noted, however, that the appended drawings illustrate only a few aspects of certain embodiments of this invention and are therefore not limiting of its scope, as the invention encompasses equally effective additional or equivalent embodiments.

DETAILED DESCRIPTION

Figure 1:
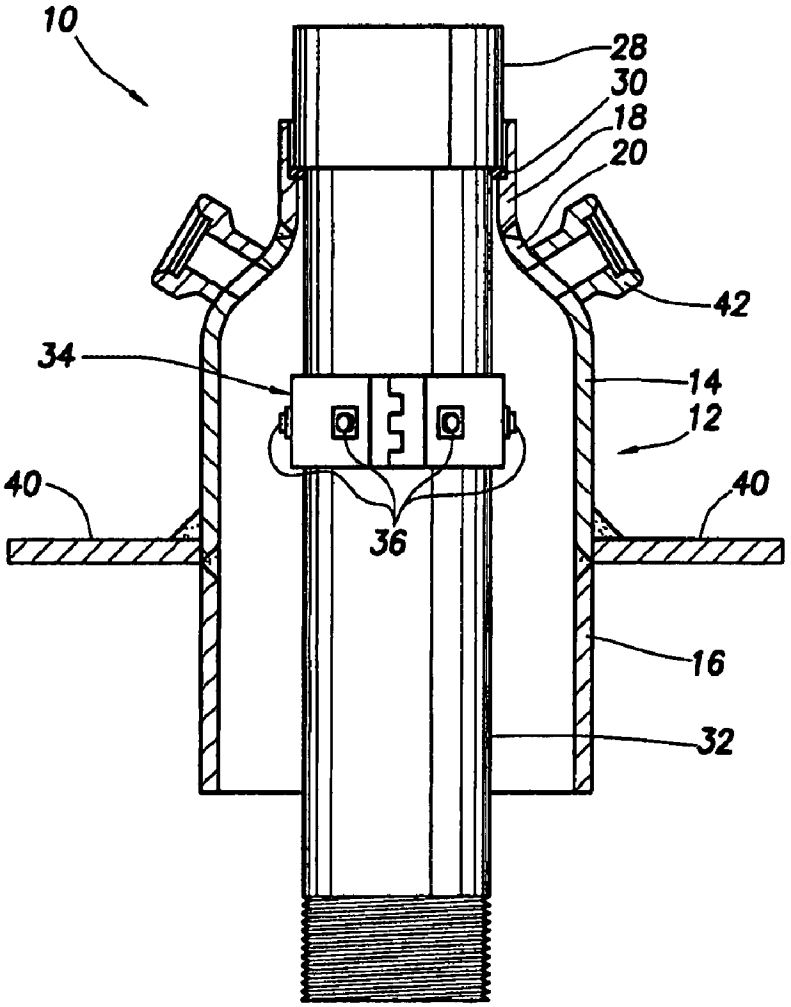
FIG. 1 is a schematic diagram of one embodiment of a surface pack-off device in accordance with the present invention.

The details of the present invention will now be described with reference to the accompanying drawings. Turning to FIG. 1, a surface pack-off device for plugging an open wellbore around a casing string extending therefrom is shown generally by reference numeral 10. The surface pack-off device or plug 10 includes a housing 12, which is generally cylindrical in shape. The housing 12 is defined by an upper section 14 and lower section 16. The upper section 14 narrows at its top forming a neck 18 and shoulder 20 therebetween.

Figure 8:
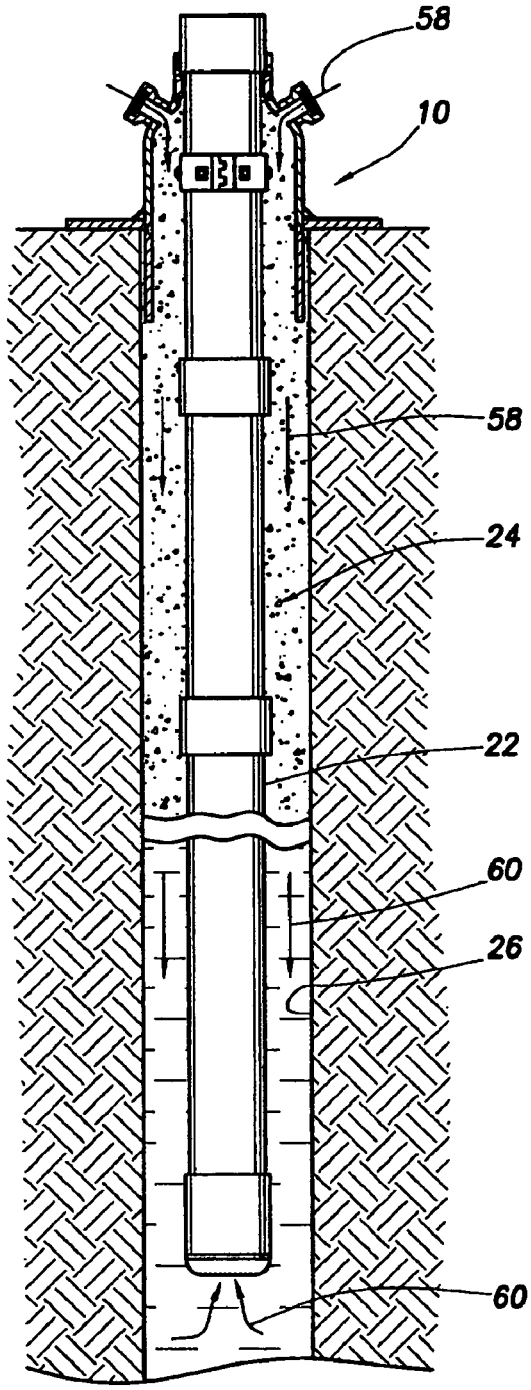
FIG. 8 illustrates the step of pumping a cement composition down the annulus between the casing and wellbore sidewall using the surface pack-off device of FIG. 1 in accordance with the reverse circulation technique of the present invention.

The housing 12 is designed to fit over and attach to a casing string 22 (shown in FIG. 8), which is the casing to be cemented. An annulus 24 is formed between the casing string 22 and wellbore sidewall 26, as shown in FIG. 8. Cement is pumped into the annulus 24 through the surface pack-off device 10 to secure the casing string 22 to the wellbore sidewall 26.

Figure 2:
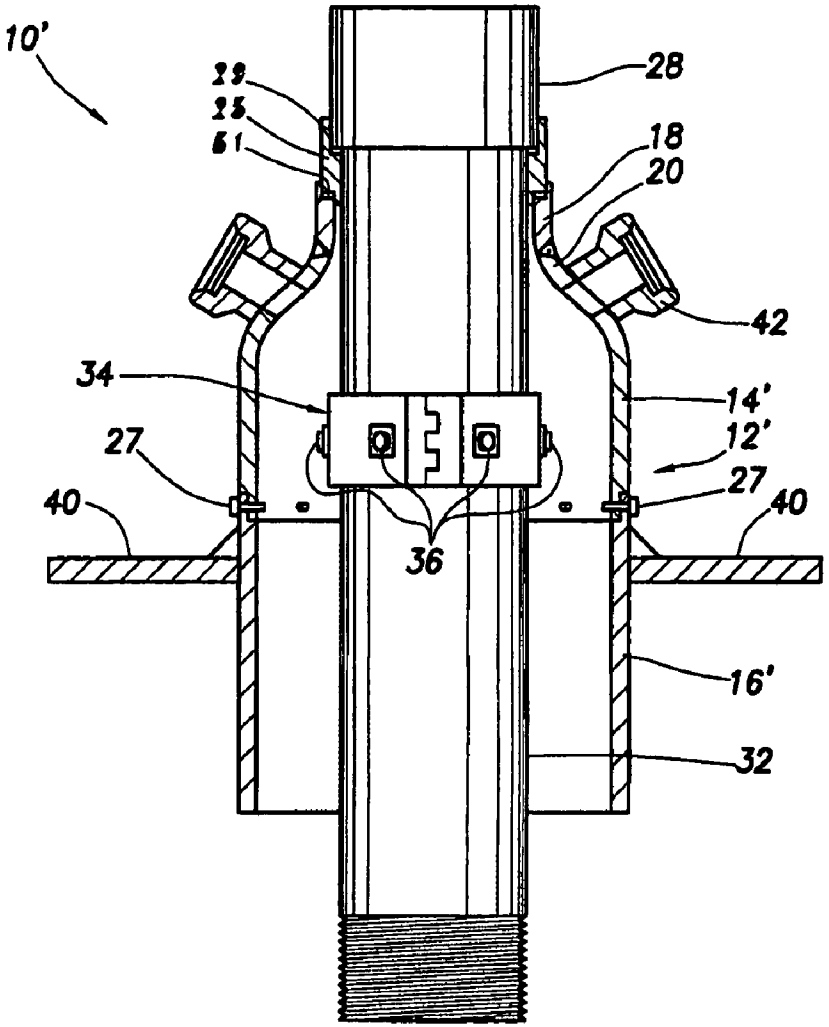
FIG. 2 is a schematic diagram of another embodiment of a surface pack-off device in accordance with the present invention.

The housing 12 of the surface pack-off device 10 in accordance with the present invention may be formed, e.g., by casting, as one piece, as shown in FIG. 1, or multiple pieces, as shown in FIG. 2. The surface pack-off device 10 of FIG. 1 is designed to be a permanent structure and therefore can serve as an inexpensive wellhead for the well. The upper section 14 of the surface pack-off device 10' of FIG. 2 is designed to be removable and therefore reusable in other wells. In the embodiment of FIG. 2, the upper section 14' of the housing 12' fits within a recess formed in the lower section 16' and is held in place by a plurality of pins 27, which can easily be removed when it is desired to remove the upper half of the surface pack-off device 10' for later reuse. As those of ordinary skill in the art will appreciate, the design can be such that the lower section 16' sits in a recess formed in the upper section 14', i.e., the reverse of what is shown in FIG. 2. Also, other means of attaching the upper section 14' of the housing 12' to the lower section 16' now known or later developed may be employed. In one exemplary embodiment, the housing 12 of the surface pack-off device 10 in accordance with the present invention is formed of a ferrous metal similar to that which is used to make the pipe forming casing string 22.

The surface pack-off device 10 further comprises a casing hanger 28, which is adapted to fit within a recess formed in the neck portion 18 of the housing 12. As those of ordinary skill in the art will appreciate, the casing hanger 28 can take many forms. In one exemplary embodiment, the casing hanger 28 is a simple threaded coupling. The casing hanger 28 sits on a flexible disc 30 formed of a material such as rubber, an elastomer, or a metal having a high modulus of elasticity, which seals the casing hanger 28 against the neck portion 18 of the housing 12. The flexible disc 30 prevents leakage of the cement composition out of the surface pack-off device 10 during the reverse circulation cementing operation.

The embodiment of FIG. 2 further includes a split casing ring 25 which fits within a recess in neck portion 18. The split casing ring 25 is formed into two or more arcuate shaped members which are detachable from an outer surface. The split casing ring 25 has an upper and lower recess. The upper recess is adapted to receive and support casing hanger 28. A flexible disc 29 sits between the upper recess of the split casing ring 25 and the casing hanger 28. Another flexible disc 31 sits between the lower recess of the split casing ring 25 and the recess in neck portion 18. The flexible discs 29 and 31 can be formed of a material, such as rubber, an elastomer, or a metal having a high modulus of elasticity. The flexible discs 29 and 31 prevent leakage of the surface pack-off device 10' during the reverse circulation cementing operations. The split casing ring 25 enables the upper section 14' of the housing 12' to be removed after the cementing job is complete as described more fully below with reference to FIGS. 9-11.

The surface pack-off device 10 further comprises a section of casing string 32, which couples to, and is suspended from, the casing hanger 28. In one exemplary embodiment, the section of casing string 32 is threaded at both ends and mates with the casing hanger 28 via a threaded connection. In such an embodiment, the casing hanger 28 is fitted with a female thread and the section of casing string 32 is fitted with a male thread. However, as those of ordinary skill will appreciate, the exact form of the connection between these two components is not critical to the invention. The section of casing string 32 is adapted to mate with the casing string 22 at the end opposite that suspended from the casing hanger 28. Again, although a threaded connection is illustrated as the means for joining these components, other means of joining these components may be employed.

The surface pack-off device 10 further comprises a limit clamp 34, which in one exemplary embodiment is formed in two half-sections hinged together. In another embodiment, the limit clamp 34 may be formed as a unitary ring that is capable of slipping onto the outer circumferential surface of the casing string 32. The limit clamp 34 is secured around the outer circumferential surface of the section of casing string 32 with a plurality of bolts 36 or other similar securing means and functions to prevent the section of casing string 32 from being pulled out of the housing 12. More specifically, the limit clamp 34 enables the surface pack-off device 10 to be transported by a handling sub 38, as described further below.

The surface pack-off device 10 further includes a load plate 40, which is secured, e.g., by welding or brazing, to the outer surface of the housing 12 between the upper section 14 and the lower section 16. The load plate 40 is generally washer-shaped; although it may have another configuration. In one exemplary embodiment, the load plate 40 has an inner diameter of about 1 ft, which approximates the outer diameter of the housing 12, and an outer diameter of about 3 ft. The load plate 40 is provided to carry the weight of the casing string 22 being cemented to the wellbore sidewall 26. It also eliminates the need for a rig to remain over the well during cementing. Additionally, the load plate 40 eliminates the need for conventional retention methods such as elevators and boards, such as railroad ties. Furthermore, the combination of the load plate 40 and the lower section 16 of the housing 12 prevents the wellbore from sloughing due to the weight of the casing being exerted on the earth near the opening of the wellbore 1. As those of ordinary skill in the art will appreciate, the dimensions of load plate 40 may vary depending upon the overall dimensions of the wellbore being cased.

The surface pack-off device 10 further comprises a plurality of fluid inlets 42 attached to the housing 12 in the shoulder section 20. The fluid inlets 42 pass fluids, e.g., cement, from outside of the well into annulus 24. In one exemplary embodiment, the surface pack-off device 10 has four fluid inlets 42, equally spaced around the circumference of the housing 12. Each fluid inlet 42 is adapted to couple the surface pack-off device 10 to a fluid supply line (not shown), so that fluid can be injected into annulus 24. In one exemplary embodiment, the fluid inlets 42 are a Weco Model No. 1502 fluid inlet. As those of ordinary skill in the art will appreciate, the exact number, size and spacing of the fluid passages may be varied depending upon a number of factors, including, the amount of fluid needed to be delivered and the desired rate at which the fluid is to be delivered.

Figure 3:
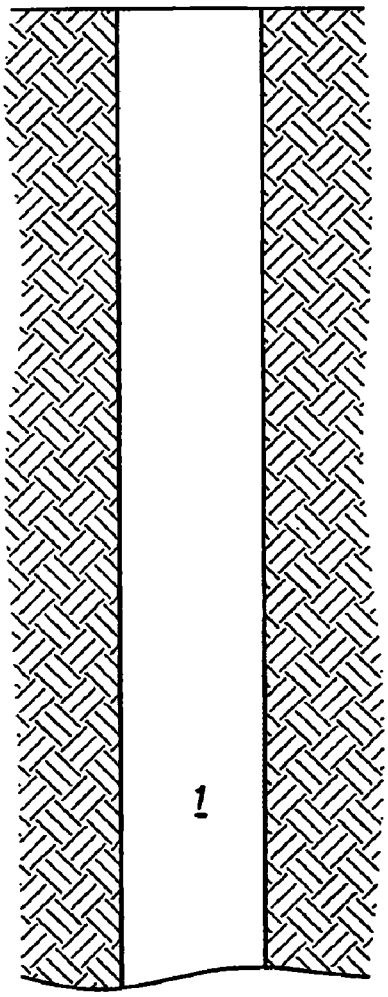
FIG. 3 illustrates the step of drilling a wellbore in accordance with the reverse circulation cementing technique of the present invention.
Figure 4:
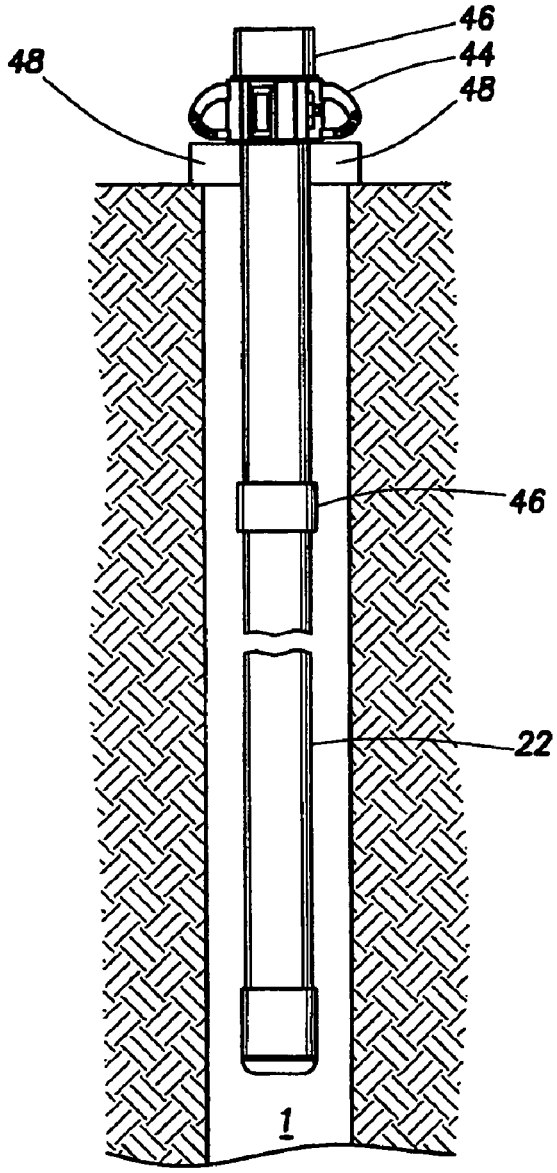
FIG. 4 illustrates the step of suspending a casing from elevators into the wellbore of FIG. 4 in accordance with the reverse circulation cementing technique of the present invention.
Figure 5:
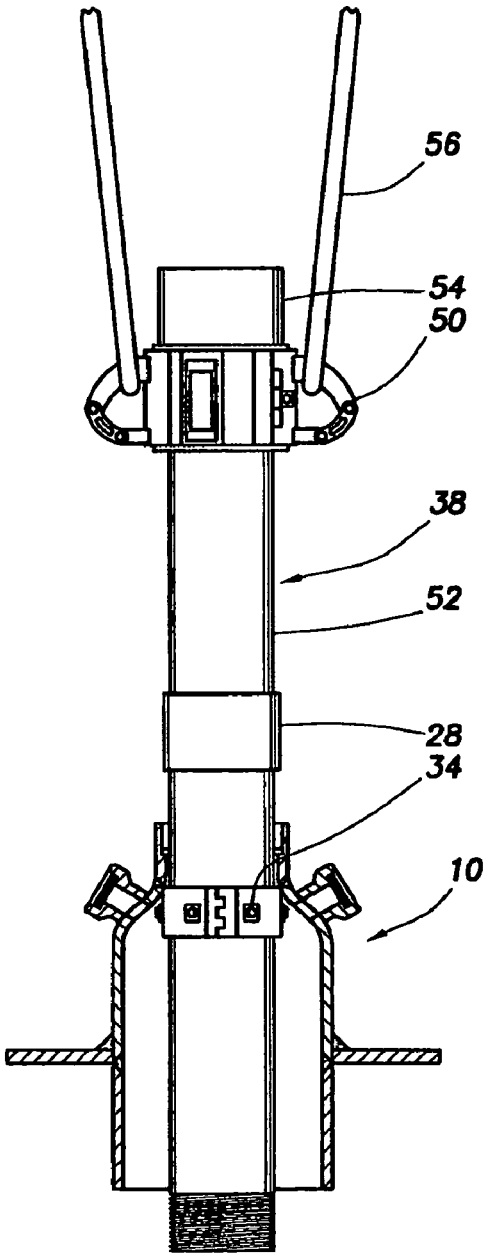
FIG. 5 illustrates the step of lifting the surface pack-off device of FIG. 1 with a handling sub prior to stabbing the suspended casing of FIG. 4 with the surface pack-off device in accordance with the reverse circulation cementing technique of the present invention.

In another aspect, the present invention is directed to a method of reverse circulation cementing a casing string 22 in an open-hole wellbore, which employs the surface pack-off device 10. In the first phase of the method, wellbore 1 is drilled in subterranean formation 2, as illustrated in FIG. 3, and the casing string 22 is installed in the wellbore 1, as illustrated in FIG. 4. The wellbore 1 can be drilled using any conventional technique. For example, a drilling rig (not shown) can be used to drill wellbore 1. Once the wellbore 1 has been drilled, the casing string 22 is installed into the wellbore 1 using a conventional drilling rig or other similar device. During this step in the process, sections of the casing string 22 are lowered into the wellbore 1 using elevators 44 or some other similar device. Adjacent sections of the casing string 22 are joined using simple threaded couplings 46. Once the entire length of casing string 22 has been lowered into the wellbore 1 by the drilling rig or other such device, the elevators 44 are lowered onto support members 48, e.g., a pair of railroad ties, until the surface pack-off device 10 is ready to be installed at the surface of the wellbore 1.

Figure 6:
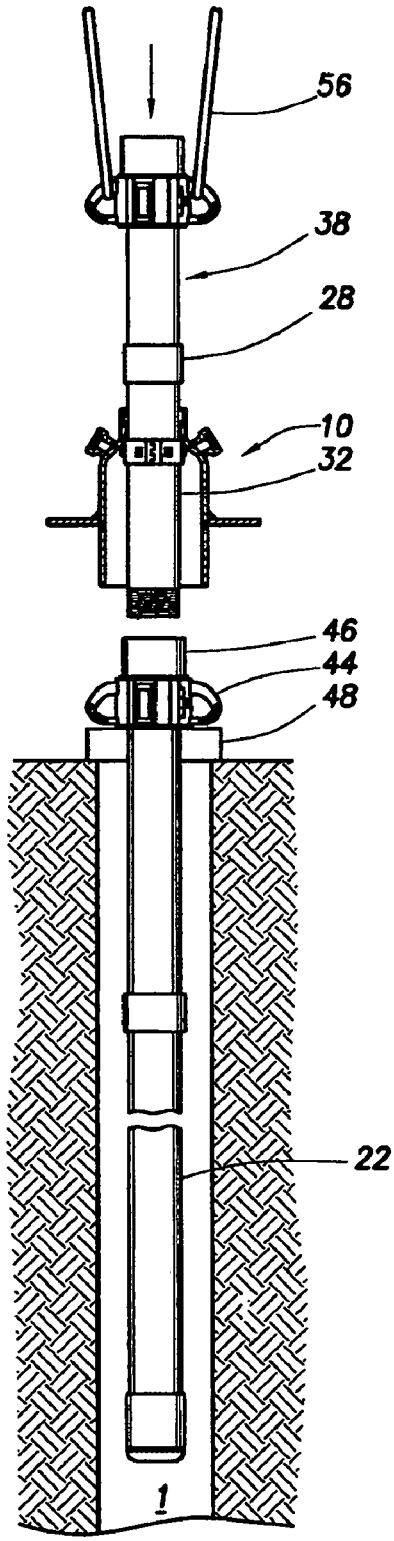
FIG. 6 illustrates the step of stabbing the suspended casing with the surface pack-off device in accordance with the reverse circulation cementing technique of the present invention.

In the next phase of the method, the surface pack-off device 10 is stabbed into the hanging casing 22 using handling sub 38. The handling sub 38 is then removed and the surface pack-off device 10 is ready for reverse circulation. In describing this part of the process, reference is made to FIGS. 5-8. In the first step in this part of the process, the handling sub 38 is coupled to the surface pack-off device 10. The handling sub 38 comprises elevators 50 clamped around threaded pipe 52, which is in turn connected to threaded coupling 54. Coupling of the handling sub 38 to the surface pack-off device is accomplished by threading threaded pipe 52 to the casing hanger 28. Once the handling sub 38 has been coupled to the surface pack-off device 10, the surface pack-off device can be lifted off of the surface from which it had been set on initial delivery to the well site. This is accomplished by aid of a workover rig (not shown), which lifts the assembly via one or more suspension bales 56 secured to elevators 50. As shown in FIG. 6, the limit clamp 34 operates to retain the section of casing string 32 within the housing 12 and through abutment against the shoulder 20 operates to carry the housing 12. The workover rig then stabs the surface pack-off device 10 into the casing string 22 suspended by elevators 44 and support members 48, as shown in FIG. 6. During this step, the well operator connects section of casing string 32 to threaded coupling 46. Once this connection is made, the elevators 44 can be unclamped from casing string 22 and the support members 48 removed. The surface pack-off device 10 can then be landed onto the opening of the wellbore 1.

Figure 7:
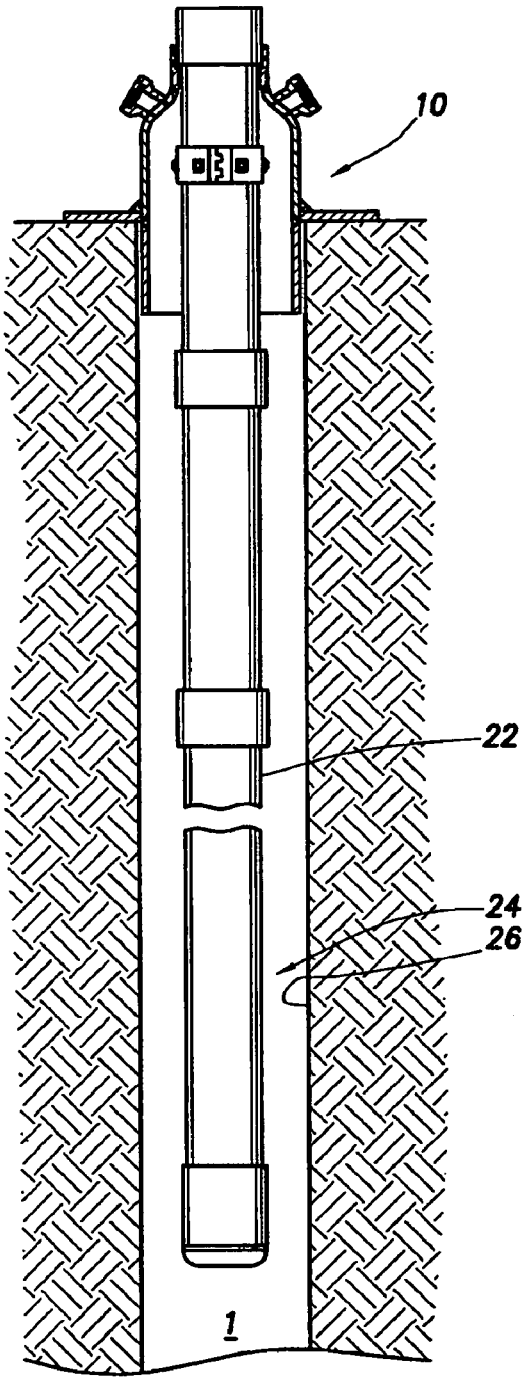
FIG. 7 illustrates the state of the well after the surface pack-off device has been stabbed into the suspended casing and the handling sub has been removed in accordance with the reverse circulation cementing technique of the present invention.

In the embodiment of FIG. 1 where the surface pack-off device 10 remains permanently in the wellbore 1, the handling sub 38 is decoupled from the surface pack-off device 10 by unthreading threaded pipe 52 from casing hanger 28. The handling sub 38 can then be lifted away from the well site. FIG. 7 illustrates the surface pack-off device 10 stabbed into the suspended casing string 22 with the elevators 44, support members 48 and handling sub 38 removed.

In the last phase of the method, a cement composition 58 is pumped downhole through the annulus 24 between the casing string 22 and wellbore sidewall 26 as indicated by the arrows in FIG. 8. This is accomplished first by connecting a tank containing the cement composition (not shown) to the fluid inlets 42 via a plurality of conduits or hoses (also not shown). Positive displacement pumps or other similar devices (not shown) can then be used to pump the cement composition 58 into the well. As pointed about above, by pumping the cement 58 downwardly through the annulus 24 rather than upwardly from the bottom of the casing string 22, it takes approximately half the time to fill the annulus 24 with cement and less pump pressure, since there is no need to lift the cement 58 up the annulus 24. As also shown, the drilling mud, debris and other contents in the wellbore can be recovered back up the casing string 22, as indicated by the arrows labeled 60 in FIG. 8. Although this involves lifting fluids back up the wellbore, because the mud, debris and other contents of the wellbore 1 are typically lighter than the cement 58, not as much pump pressure is required.

Figure 9:
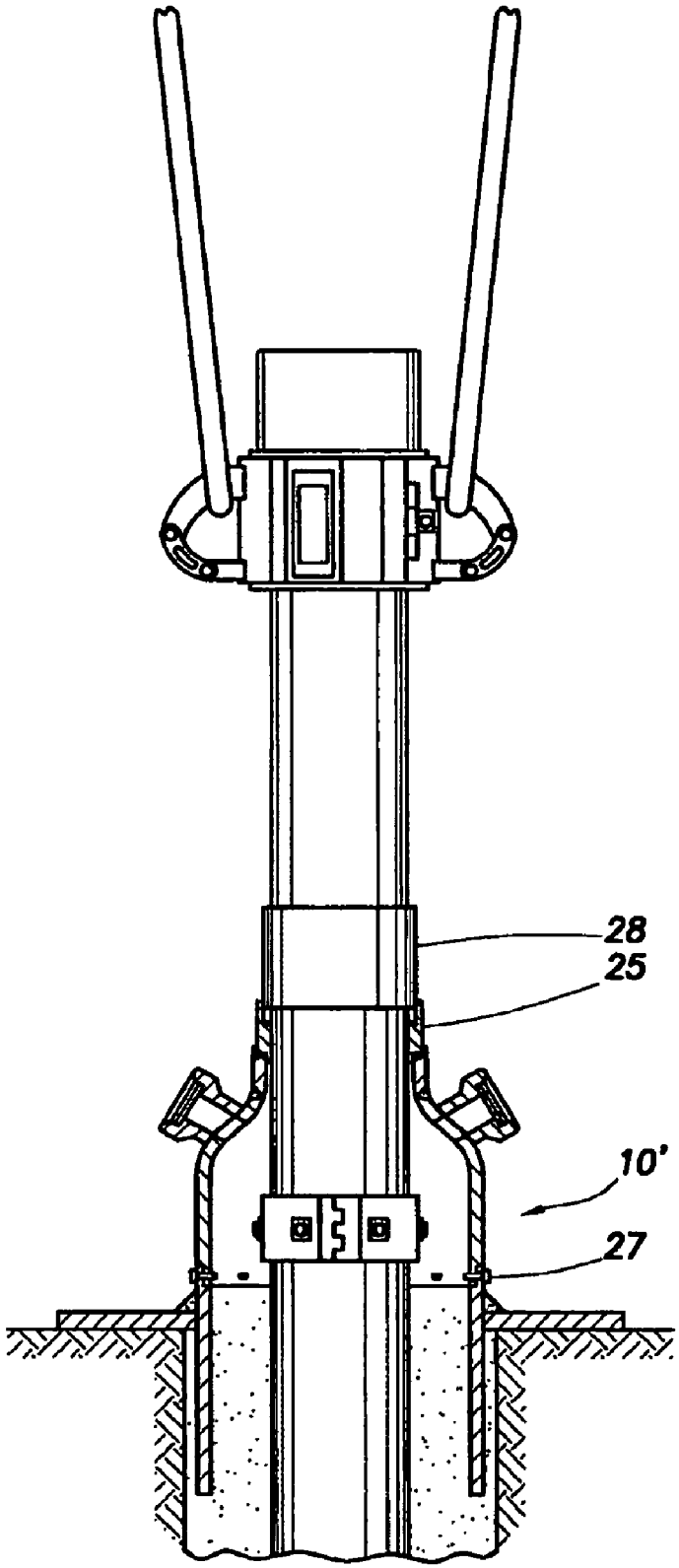
FIGS. 9-11 illustrate the steps of removing the upper section of the housing of the surface pack-off device from the lower section of the housing of the surface pack-off device after the cementing job has been completed.
Figure 10:
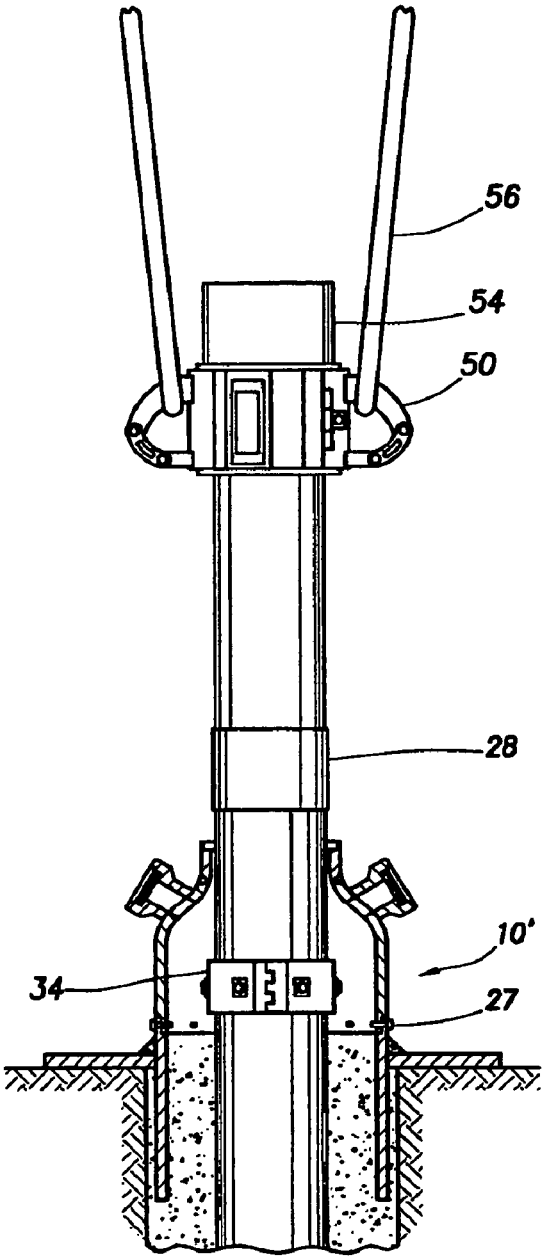
Figure 11:
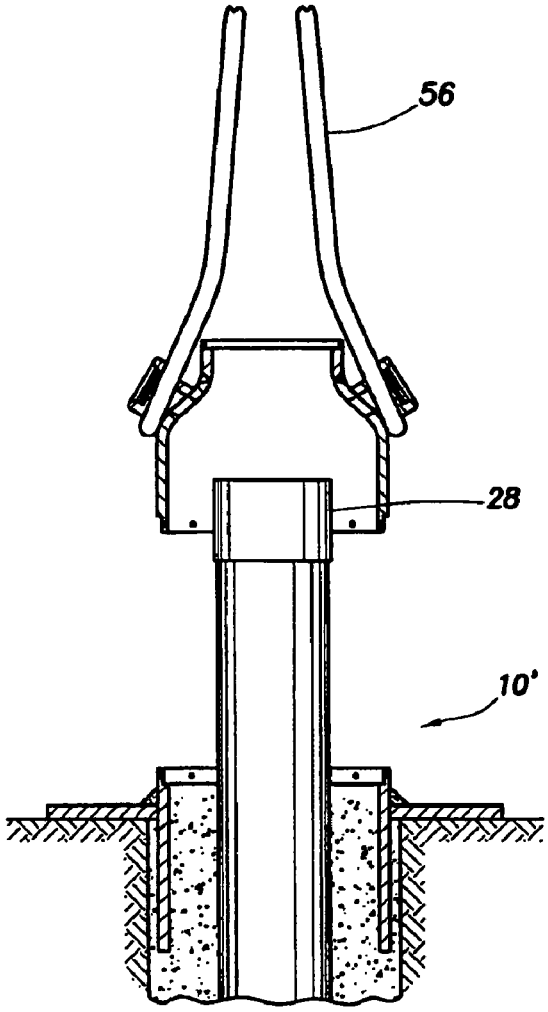

After the cement 58 has set, the surface pack-off device 10 can optionally be left in place and thus serve as a permanent wellhead, or it can be removed, if, e.g., the embodiment of the surface pack-off device 10' illustrated in FIG. 2 is employed. If the surface pack-off device 10' is to be removed, the step of decoupling the threaded pipe 52 from the casing hanger 28 is not carried out until after the cement job is completed. Rather, after the cement job is completed, the handling sub 38 is lifted upward by the rig by pulling on bales 56. This causes the casing hanger 28 to be lifted off of the split casing ring 25 and associated flexible disc 30, as shown in FIG. 9. Once the casing hanger 28 has been lifted off of the split casing ring 25, the split casing ring can be removed. Next, the threaded pipe 52 can be decoupled from the casing hanger 28 (shown in FIG. 10) and the pins 27, which secure the upper section 14' of the surface pack-off device 10' to the lower section 16' of the pack-off device 10' can be removed. Finally, the workover rig can then lift the upper section of the surface pack-off device 10' off of the well using bales 56, as shown in FIG. 11, and place it on a transport vehicle (not shown) for subsequent use. Also, if a hinged limit clamp 34 is used, it can be removed and reused. The benefit of the surface pack-off device 10' is that all of the components, except for the lower section 16', the section of casing pipe 32, and load plate 40', can be salvaged for reuse, thereby making the surface pack-off device 10' essentially reusable.

Figure 12A:
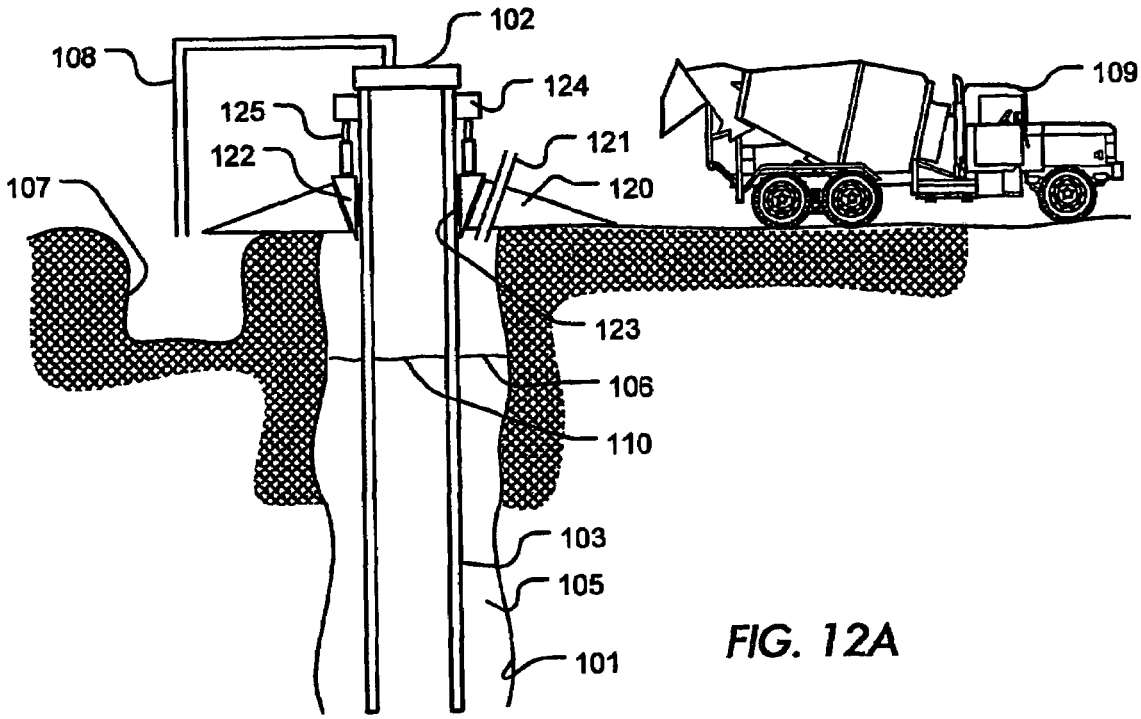
FIG. 12A is a cross-sectional, side view of a wellbore and casing wherein an annular plug is attached to the casing at the mouth of the wellbore.

FIG. 12A illustrates a cross-sectional, side view of a wellbore and casing. This wellbore has a casing 103 sticking out of the mouth of the wellbore 101 without an installed surface casing or well head. An annulus 105 is defined between the casing 103 and the wellbore 101. A truck 109 is parked near the wellbore and a reservoir 107 is also located nearby. The wellbore 101 is also filed with circulation fluid such that an annulus circulation fluid surface 106 is approximately level with an ID circulation fluid surface 110.

Figure 12B:
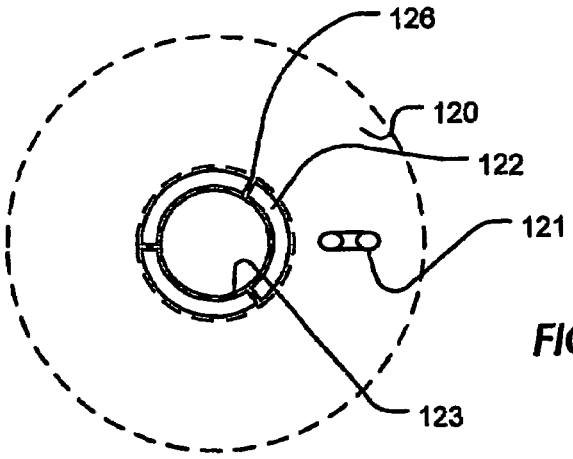
FIG. 12B is a top view of the annular plug shown in FIG. 12A, wherein slips and a seal are positioned within the annular plug.

An annular plug 120 is positioned over the exposed end of the casing 103 and lowered until it rests on the soil at the mouth of the wellbore 101. As illustrated, the annular plug is a conical shape structure with a hole through its center. The inside hole of the annular plug 120 is also a conical shape so as to receive slips 122 between the annular plug 120 and the casing 103. An annular seal 123 is positioned between the casing 103 and the slips 122. FIG. 12B illustrates a top view of the slips 122 and annular seal 123 positioned within the annular plug 120 (shown in dotted lines). Sectional seals 126 are positioned between the slips 122 to seal the gaps between the slips 122.

Referring again to FIG. 12A, an anchor 124 is attached to the casing 103 above the slips 122. Any method known to persons of skill may be used to attach the anchor, such as set screws, welding, fastening two halves with bolts, threading, etc. Jacks 125 are positioned between the slips 122 and the anchor 124. Any type of jacks known to persons of skill may be used such as hydraulic, screw, scissor, etc. A single jack or any number of jacks may be used, but in at least only embodiment, the force from the jacks is evenly distributed across the slips 122. When the jacks 125 are activated, they anchor themselves against the anchor 124 and push the slips 122 downward into the annular plug 120. Because the inner hole of the annular plug 120 and the slips 122 are conical in shape, the slips wedge themselves between the casing 103 and the annular plug 120 as the downward force generated by the jacks 125 is increased (the annular seal 123 is positioned between the slips 122 and the casing 103). Because the slips 122 and the annular plug 120 are allowed to slide relative to the casing 103, the jacks 125 also press the annular plug 120 firmly against the soil at the mouth of the wellbore 101. In this manner, the annular plug 120 completely seals the annulus 105 at the top of the wellbore 101.

The annular plug 120 also has a conduit 121 extending through the main conical section. The conduit 121 may have a nipple (not shown) for connecting pipes or hoses. Also, a casing ID coupler 102 is attached to the exposed end of the casing 103 above the annular plug 120. The casing ID coupler 102 may be attached to the exterior or the ID of the casing 103, so long as it seals the open end. It may use dogs or slips to engage the casing. A return line 108 is connected to the casing ID coupler 102 for communicating circulation fluid from the ID of the casing 103 to the reservoir 107.

With the annular plug 120 and casing ID coupler 102 attached to the casing 103, a cementing operation may be conducted on the wellbore 101. A pipe or hose (not shown) is connected from the truck 109 to the conduit 121. Premixed cement trucks and pump trucks are illustrated in the various figures of this disclosure. It is to be understood that any type of cement composition and any type of pumping apparatus may be used to pump the cement composition into the annulus. Cement composition is pumped into the annulus 105 through the conduit 121. As the cement composition flows in to the annulus 105, the cement composition contacts the annulus circulation fluid surface 106. Some of the cement composition will free fall in the circulation fluid. To establish fluid flow in a reverse circulation direction, a certain static pressure must be induced to overcome the static gel strength of the circulation fluid in the wellbore. Thus, the cement composition is pressurized to drive the circulation fluid downward in the annulus 105. As the circulation fluid flows from the annulus 105 to the casing ID through the casing shoe (not shown), returns are taken at the casing ID coupler 102 through the return line 108 for deposit in the reservoir 107. The seal of the annulus provided by the annular plug 120 allows for the static fluid pressure to be increased in the annulus. As additional cement composition is pumped into the annulus, the column weight of the cement composition begins to drive fluid flow in the reverse circulation direction so that the static fluid pressure inside the annulus at the annular plug may be reduced. Flow regulators, valves, meters, etc. may also be connected to the annular plug 120, conduit 121, casing 103, casing ID coupler 102, and/or return line 108 to monitor the state of the fluids at various locations in the system.

Figure 13A:
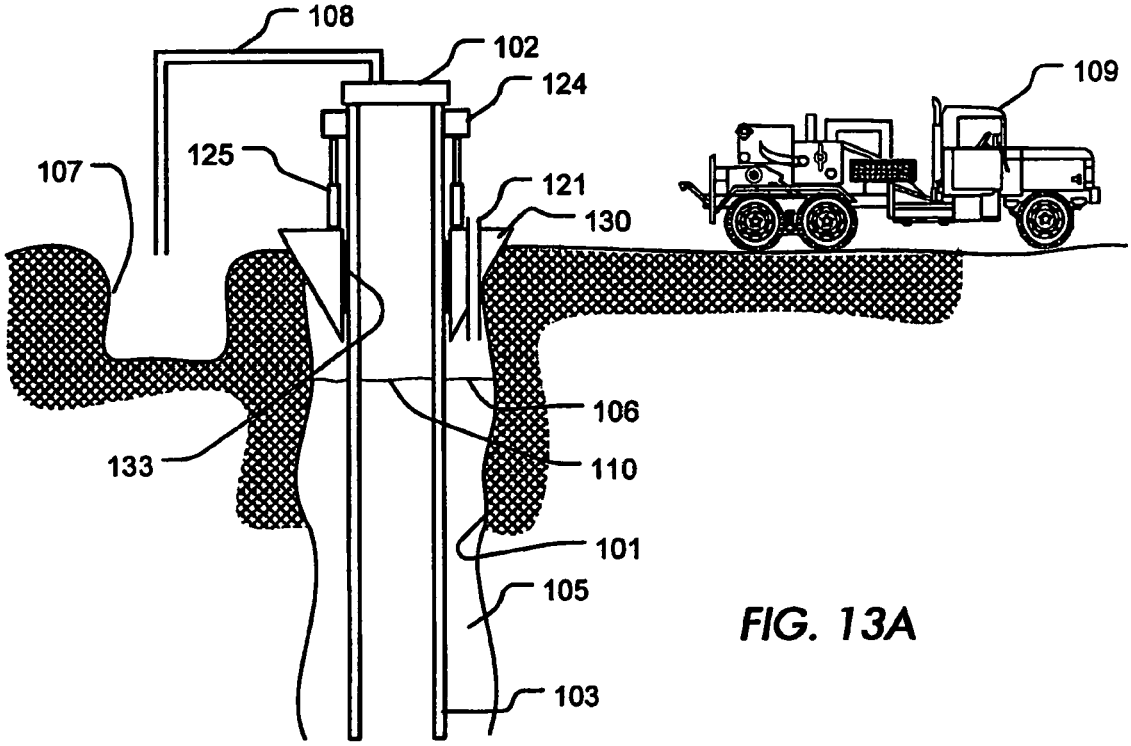
FIG. 13A is a cross-sectional, side view of a wellbore and casing wherein a sectional plug is mounted in the annulus at the top of the wellbore.

FIG. 13A illustrates a cross-sectional, side view of a wellbore and casing. This wellbore has a casing 103 sticking out of the mouth of the wellbore 101 without an installed surface casing or well head. An annulus 105 is defined between the casing 103 and the wellbore 101. A truck 109 is parked near the wellbore and a reservoir 107 is also located nearby. The wellbore 101 is also filed with circulation fluid such that an annulus circulation fluid surface 106 is approximately level with an ID circulation fluid surface 110.

Figure 13B:
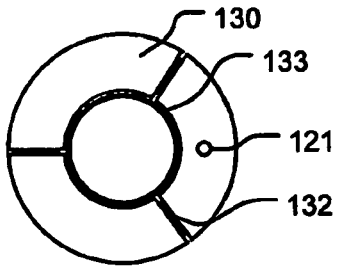
FIG. 13B is a top view of the sectional plug illustrated in FIG. 13A, wherein seals are positioned between the sections of the sectional plug.

In this embodiment, a sectional plug 130 is used to seal the annulus 105 at the top of the wellbore 101. FIG. 13B illustrates a top view of the sectional plug shown in FIG. 13A. The sectional plug 130 has three arcuate sections, which together combine to form an annular structure for insertion into the annulus 105. The sectional plug 130 is a conical structure with a hole in the middle. The hole in the middle is cylindrical and has a diameter slightly larger than the outside diameter of the casing 103. A cylindrical annular seal 133 is positioned between the sectional plug 130 and the casing 103. While the illustrated embodiment has three arcuate sections forming the sectional plug 130, is should be understood that any number of arcuate sections may be used to form the annular structure.

To seal the annulus 105, the annular seal 133 is fitted around the casing immediately below the mouth of the wellbore 101. The sections of the sectional plug 130 are then inserted into the annulus 105 between the annular seal 133 and the mouth of the wellbore 101. Sectional seals 132 are positioned between adjacent sections of the sectional plug 130. With the seals and sectional plug in place, an anchor 124 is attached to the casing 103 above the sectional plug 130. Jacks 125 are then positioned between the anchor 124 and the sectional plug 130. As described above, any anchor or jack may be used. When the jacks 125 are extended, the jacks press against the anchor 124 to drive the sectional plug 130 deeper into the annulus 105. Because the sectional plug 130 is a conical shape, the sectional plug become tightly wedged in the annulus 105. As the sectional plug 130 moves deeper in the annulus, the wellbore 101 presses the sectional plug 130 toward the casing 103 to shrink fit the sectional plug 130 around the annular seal 133 and squeeze the sectional seals 132.

In alternative embodiments of the invention, the sections of the sectional plug 130 may be coupled together after they are inserted into the mouth of the annulus. Also, a solid annular ring may be positioned between the sectional plug 130 and the jacks 125 so that force applied by the jacks is even distributed to the sectional plug 130.

The sectional plug 130 also has a conduit 121 for communicating fluid to and from the annulus 105. A casing ID coupler 102 is also attached to the casing 103 to seal the ID of the casing 103. A return line 108 is attached to the casing ID coupler 102 for communicating fluids from the ID of the casing 103 to a reservoir 107. With the sectional plug 130 firmly in place in the annulus at the mouth of the wellbore 101, cement may be pumped into the annulus 105 through the conduit 121. As illustrated, the annular circulation fluid surface 106 is level with the ID circulation fluid surface 110. When a cement composition is pumped into the annulus 105 through conduit 121, the fluid pressure in the annulus 105 begins to build. The static fluid pressure in the annulus 105 eventually become great enough to overcome the gel strength of the circulation fluid in the wellbore 101, so as to initiate fluid flow in the wellbore in a reverse circulation direction. As more cement composition is pumped into the annulus, fluid returns are taken from the ID of the casing 103 through the return line 108 for deposit in the reservoir 107. While a certain static fluid pressure overcomes the gel strength of the circulation fluid, the sectional plug 130 provides a sufficient seal at the mouth of the wellbore to prevent the cement composition from leaking out the top of the annulus 105. Once fluid flow through the wellbore is established, the static fluid pressure in the annulus 105 at the mouth of the wellbore may be reduced. As more and more cement composition is pumped into the annulus, the additional weight of the cement composition continues to drive fluid flow in the wellbore in the reverse circulation direction.

Therefore, the present invention is well-adapted to carry out the objects and attain the ends and advantages mentioned as well as those which are inherent therein. While the invention has been depicted, described, and is defined by reference to exemplary embodiments of the invention, such a reference does not imply a limitation on the invention, and no such limitation is to be inferred. The invention is capable of considerable modification, alteration, and equivalents in form and function, as will occur to those ordinarily skilled in the pertinent arts and having the benefit of this disclosure. The depicted and described embodiments of the invention are exemplary only, and are not exhaustive of the scope of the invention. Consequently, the invention is intended to be limited only by the spirit and scope of the appended claims, giving full cognizance to equivalents in all respects.

What is claimed is:

1. A method of cementing a casing in an open wellbore having no surface casing, wherein an annulus is defined between the casing and the wellbore, the method comprising:

sealing the annulus with a plug around the casing at the mouth of the wellbore, wherein the plug comprises a housing, a load plate secured to the housing, at least one fluid inlet formed in the housing, and a casing hanger adapted to fit within the housing;

pumping a cement composition into the annulus through the plug; and taking circulation fluid returns from the inner diameter of the casing.

2. The method of claim 1 wherein sealing the annulus with the plug around the casing comprises placing a unitary annular plug over an exposed end of the casing.

3. The method of claim 1 wherein sealing the annulus with the plug around the casing comprises placing a plurality of plug segments around the casing in the annulus at the mouth of the wellbore.

4. The method of claim 1 wherein pumping the cement composition into the annulus through the plug comprises pumping through a conduit that extends through the plug.

5. The method of claim 1 further comprising permanently installing the plug at the surface opening of the wellbore after the casing has been cemented to a sidewall of the wellbore.

6. The method of claim 1 further comprising lowering the casing into the wellbore with elevators and one or more support members.

7. The method of claim 1 further comprising stabbing the casing with a handling sub.

8. The method of claim 1 wherein: sealing the annulus with the plug around the casing comprises installing a surface plug at a surface opening of the open wellbore;

the plug comprises a housing having a casing hanger suspended therein;

the casing is suspended from the casing hanger;

an annulus is formed between a section of the casing and the housing;

a load plate is secured to the housing; and a lower portion of the housing and the load plate cooperate to prevent collapse of the wellbore at the surface.

9. The method of claim 8 further comprising permanently installing a lower section of the housing and the load plate at the surface opening of the wellbore after the casing has been cemented to a sidewall of the wellbore, and removing the remaining components of the plug.

10. The method of claim 8 further comprising securing a limit clamp to an outer circumferential surface of a section of casing and retaining the section of the casing within the housing with the limit clamp.

11. A system for cementing a casing in an open wellbore having no surface casing, wherein an annulus is defined between the casing and the wellbore, the system comprising:

an annular plug around the casing at the mouth of the wellbore, wherein the annular plug comprises a housing, a load plate secured to the housing, at least one fluid inlet formed in the housing, and a casing hanger adapted to fit within the housing;

a cement composition pump fluidly connected to the annulus through the annular plug; and a coupling connected to an exposed end of the casing for taking circulation fluid returns from the inner diameter of the casing.

12. The system of claim 11 wherein the annular plug comprises a unitary annular plug configured for placement over the exposed end of the casing.

13. The system of claim 11 wherein the annular plug comprises a plurality of plug segments.

14. The system of claim 11 wherein the housing comprises:

a generally cylindrically-shaped main body portion;

a neck portion; and a shoulder portion connecting the neck portion to the main body portion.

15. The system of claim 14 wherein the neck portion of the housing has a recess formed therein, and the system further comprises a flexible disc disposed between the casing hanger and the recess of the neck portion of the housing.

16. The system of claim 14 wherein the neck portion of the housing has a recess formed therein, and the system further comprises a removable split casing ring disposed between the casing hanger and the recess.

17. The system of claim 16 further comprising a flexible disc disposed between the removable split casing ring and the recess, and a flexible disc disposed between the removable casing ring and the casing hanger.

18. The system of claim 11 further comprising a limit clamp secured around an outer circumferential surface of a section of the casing, wherein the limit clamp is adapted to retain the section of casing within the housing.

19. The system of claim 11 wherein the housing comprises an upper section and a lower section, and the system further comprises a plurality of pins securing the upper section of the housing to the lower section of the housing.

* * * * *